US005181357A

United States Patent [19]

Pourtau et al.

[11] Patent Number: 5,181,357

[45] Date of Patent: Jan. 26, 1993

[54] PROFILED, STRIP PARTICULARLY ADAPTED TO COMPENSATE THE RELATIVE DISPLACEMENTS OF A FLOOR COVERING WITH RESPECT TO AN ADJACENT WALL AND PROCESS FOR MANUFACTURING SUCH A PROFILED STRIP

[75] Inventors: Jean-Jacques Pourtau; Thierry E. Pourtau, both of Croissy sur Seine, France

[73] Assignee: Tomecanic, France

[21] Appl. No.: 673,598

[22] Filed: Mar. 22, 1991

[30] Foreign Application Priority Data

Mar. 30, 1990 [FR] France ..... 90 04117

[51] Int. Cl.[5] ..... E04F 15/00; E04F 19/02

[52] U.S. Cl. ..... 52/179; 52/287; 52/288; 52/256; 428/49; 428/192; 425/131.1

[58] Field of Search ..... 52/177, 179, 287, 288, 52/254–256, 716–718; 428/43, 192; 425/131.1, 287, 288, 376.1

[56] References Cited

U.S. PATENT DOCUMENTS

| | | | |
|---|---|---|---|
| 2,230,688 | 2/1941 | Irwin | 52/288 |
| 3,334,456 | 8/1967 | Naka | 52/179 |
| 4,318,951 | 3/1982 | Naka et al. | 52/179 X |
| 4,411,112 | 10/1983 | Golden | 52/288 |
| 5,073,430 | 12/1991 | Aidan | 52/179 X |

FOREIGN PATENT DOCUMENTS

| | | | |
|---|---|---|---|
| 165611 | 6/1985 | European Pat. Off. . | |
| 198157 | 1/1986 | European Pat. Off. . | |
| 8502738 | 2/1985 | Fed. Rep. of Germany . | |
| 8907979 | 6/1989 | Fed. Rep. of Germany . | |
| 1094756 | 5/1955 | France | 52/281 |
| 571131 | 12/1975 | Switzerland | 52/288 |
| 356829 | 9/1931 | United Kingdom . | |
| 2096060 | 2/1982 | United Kingdom . | |

*Primary Examiner*—Richard E. Chilcot, Jr.
*Attorney, Agent, or Firm*—Marshall & Melhorn

[57] ABSTRACT

This invention relates to a profiled strip particularly adapted to compensate the relative displacements of surface coverings with respect to the walls, wherein said profiled strip comprises: a generally flat sole plate; two principal limbs which extend from the sole plate, perpendicularly thereto; a bridge for connecting the ends of said principal limbs and two secondary limbs which extend substantially parallel to the sole plate, from the principal limb most remote from the free edge of the sole plate, these two secondary limbs having substantially equal widths; the sole plate and the principal limbs being made of a hard, semi-rigid material, and the connecting bridge being made of a supple material.

One application of the invention is production of the zone of connection between a tiled floor and partition.

21 Claims, 3 Drawing Sheets fig.1
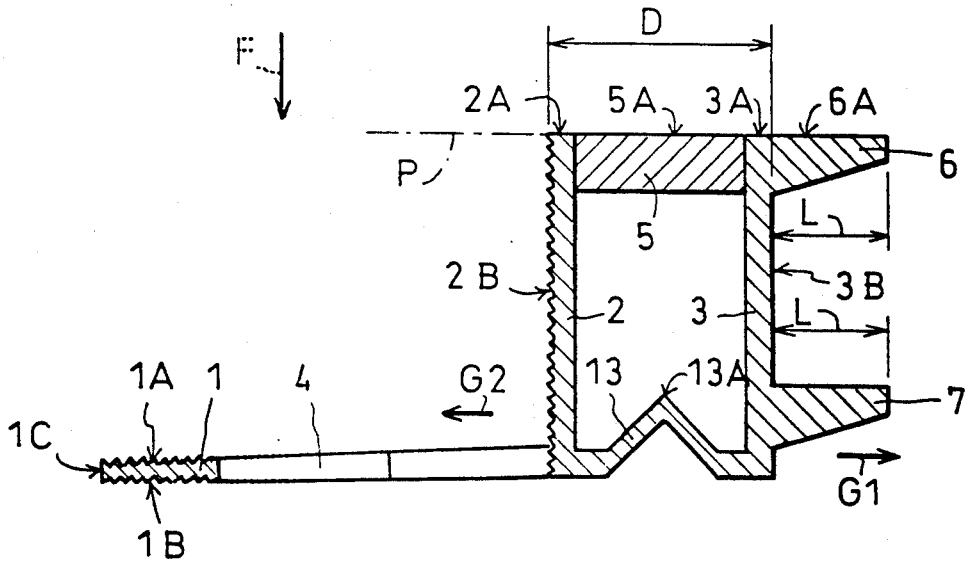
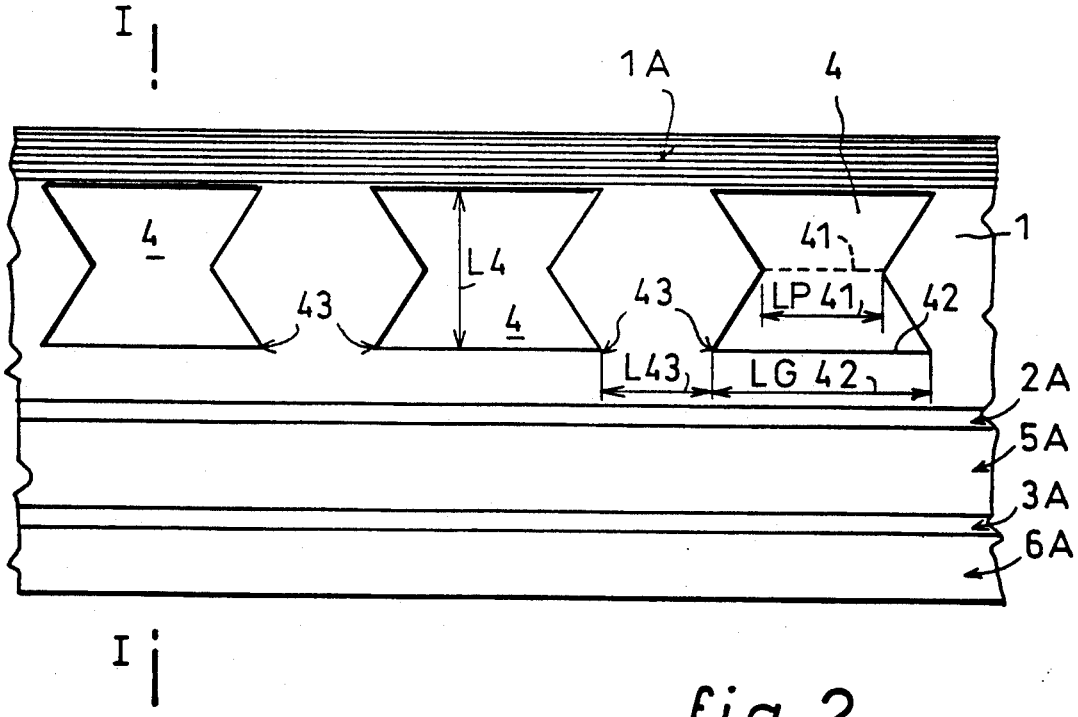
fig.2 fig_3
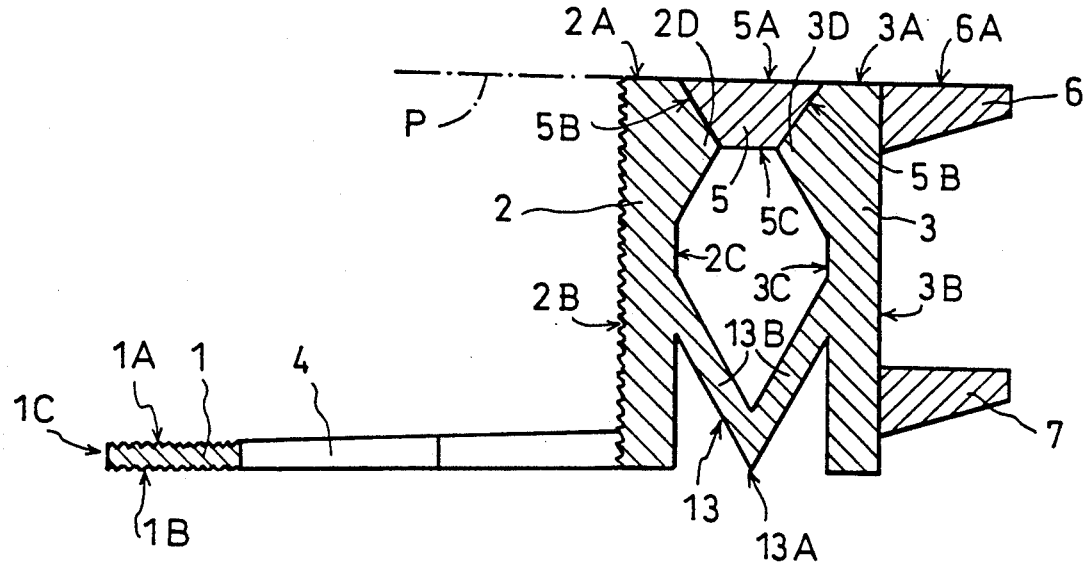
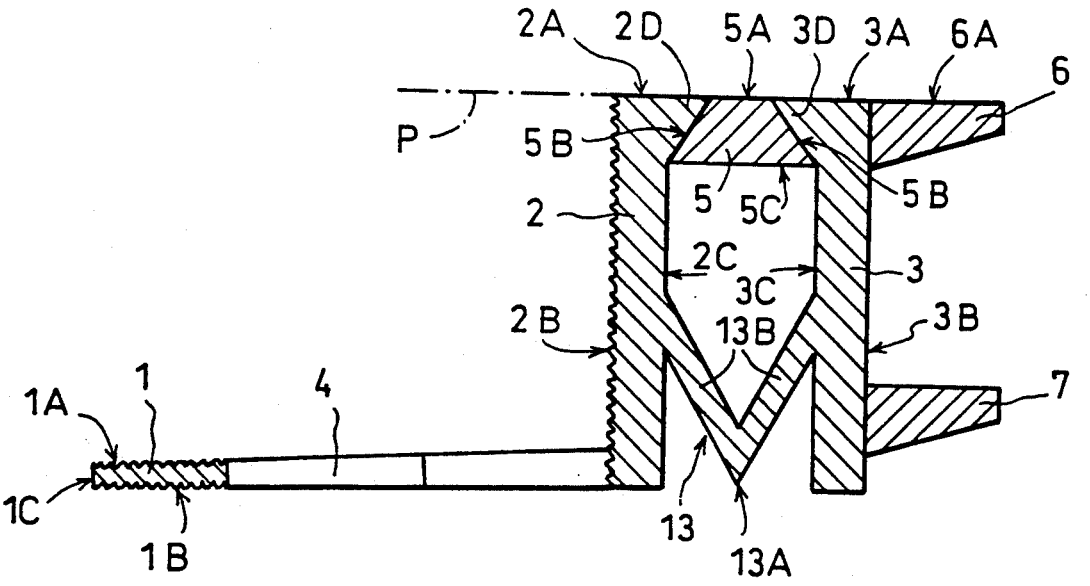
fig_4

PROFILED, STRIP PARTICULARLY ADAPTED TO COMPENSATE THE RELATIVE DISPLACEMENTS OF A FLOOR COVERING WITH RESPECT TO AN ADJACENT WALL AND PROCESS FOR MANUFACTURING SUCH A PROFILED STRIP

FIELD OF THE INVENTION

The present invention relates to a profiled strip particularly adapted to compensate the relative displacements of a floor covering with respect to an adjacent wall, and to a process for manufacturing such a profiled strip.

BACKGROUND OF THE INVENTION

The domain of the invention is firstly illustrated by the following example. Tilings laid with conventional cement mortar or glued with adhesive mortar undergo tensions, expansions or shrinkages which thus cause their dimensions to vary. Such tensions may have two principal origins, viz. thermal or physical. In fact, the slabs supporting the tilings may cause inevitable dimensional variations in said tilings when a new building is constructed, for example. These tensions thus provoke on the surface of the tilings cracks and sometimes even cause separations. Supple joints inserted in the very surface of the tiling must therefore be provided in order to enable said tiling to withstand dimensional variations and movements.

To that end, profiled strips forming joints exist, purporting to solve these problems. Unfortunately, certain do not present characteristics adapted to assume correct use of the tiling, and others are recommended to be placed at the centre of the rooms, leading to an unaesthetic effect.

It is an object of the invention to propose a profiled strip allowing a satisfactory final product to be obtained.

SUMMARY OF THE INVENTION

The invention therefore firstly relates to a profiled strip particularly adapted to compensate the relative displacements of surface coverings, such as in particular the shrinking and expanding movements of floor coverings, and comprising a generally flat sole plate; two principal limbs substantially parallel to each other which extend perpendicularly thereto; and a bridge for connecting the ends of said principal limbs most remote from the sole plate; the sole plate and the two principal limbs being made of a hard, semi-rigid material such as hard, semi-rigid PVC, and the connecting bridge being made of a supple material such as a supple PVC.

According to the invention, this profiled strip is adapted to compensate the relative displacements of floor coverings with respect to the adjacent walls and partitions, whilst the two principal limbs extend in an end zone of the sole plate, and two secondary limbs extend substantially parallel to the sole plate, from that face, most remote from the free edge of the sole plate, of the principal limb, itself most remote from said free edge of the sole plate, these two secondary limbs extending in the direction opposite the one in which the sole plate extends, having substantially equal widths.

The following advantageous arrangements are, in addition, preferably adopted:

the secondary limbs are made either of a hard, semi rigid material such as a hard, semi-rigid PVC, or of a supple material, such as a supple PVC;

the ends of the principal limbs opposite the sole plate, the outer face of the connecting bridge, and the outer face of the secondary limb most remote from the sole plate are substantially coplanar;

the width of the secondary limbs is included between 0.4 and 0.6 times the distance separating the outer faces of the two principal limbs, preferably being substantially equal to 0.5 times this distance;

in addition, a connecting structure, having the form of a V, contained between said principal limbs, connects the latter;

that part of the sole plate included between the two principal limbs forms an upturned V, of which the apex is contained between said two principal limbs;

the ends of the arms of the V of said connecting structure are connected to the median parts of the inner faces of said principal limbs;

the V structure is monobloc with said principal limbs;

said connecting bridge is shaped as a trapezium of which the sides connecting its parallel bases are connected to projections with which the inner faces of said principal limbs are provided;

the outer face of the principal limb closest to the free edge of the sole plate is striated over the whole of its length and height;

the bearing sole plate presents perforations each shaped as two equal trapezia having their small bases merged into a common small base, these various perforations being separated by solid parts;

this profiled strip presents the following dimensions: a) the common small base of the trapezia of a perforation has a length which is greater than half the length of a large base; b) the width of a perforation, equal to the sum of the heights of the two trapezia constituting it, is included between 0.5 and 1 times the length of the large base of a trapezium; c) the distance of the solid part separating the angles of two large bases of the trapezia of two successive perforations is included between 0.4 and 0.6 times the length of the large base of a trapezium;

said trapezia are isosceles trapezia;

the lower face of the bearing sole plate comprises parallel striae over the whole of its length and width;

the upper face of the solid parts of the bearing sole plate comprises parallel striae over the whole of its length and width.

The present invention also relates to a process for manufacturing a profiled strip as defined hereinbefore, wherein said profiled strip is made by extruding the materials constituting it, simultaneously.

Such extrusions are preferably effected hot.

The principal advantage of the profiled strips according to the invention resides in the separation obtained of the floor covering with respect to the adjacent walls and partitions, whilst naturally conserving an outer appearance providing a satisfactory, long-lasting finish of the zones of connection of said floor covering with said walls and partitions.

BRIEF DESCRIPTION OF THE DRAWINGS

The invention will be more readily understood on reading the following description with reference to the accompanying drawings, in which:

FIG. 1 is a section along I—I of FIG. 2 of a profiled strip according to a first variant embodiment of the invention.

FIG. 2 is a view in the direction of arrow F of FIG. 1.

FIGS. 3 and 4 are sections, similar to that of FIG. 1, of two other variant embodiments, likewise in accordance with the invention.

DETAILED DESCRIPTION OF THE DRAWINGS

Figure 5:
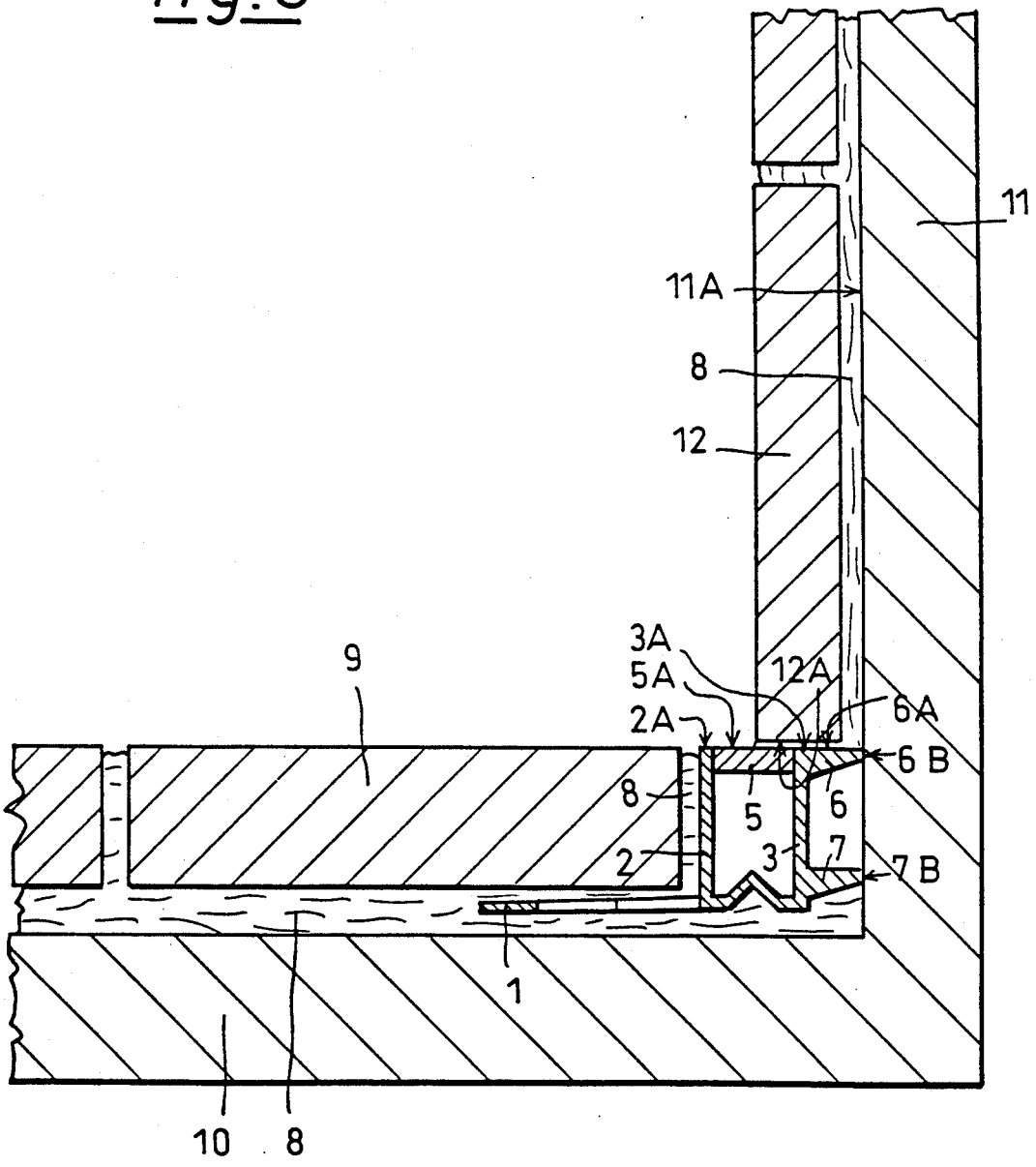
FIG. 5 is a view in section of a floor and a partition, and of the profiled strip of FIGS. 1 and 2 used in the zone of connection of the floor and the partition.

Referring now to the drawings, the profiled strip shown in FIGS. 1 and 2 comprises:

a generally flat sole plate 1;

two principal limbs 2, 3, substantially parallel to each other, which extend from the upper face 1A of an end zone of the sole plate 1, perpendicularly thereto;

a bridge 5 for connecting the ends of the principal limbs 2, 3 most remote from the sole plate 1; and two secondary limbs 6, 7 which extend substantially parallel to the sole plate 1, from the face 3B, which is most remote from the free edge 1C of the sole plate 1, of the principal limb 3 itself the most remote from said free edge 1C, these two secondary limbs 6, 7 extending in the direction G1 opposite that, G2, in which the sole plate extends and having widths substantially equal to the same value L;

the sole plate 1, the two principal limbs 2, 3 and the two secondary limbs 6, 7 are made of a hard, semi-rigid material, here a hard, semi-rigid PVC, and the connecting bridge 5 is made of a supple material, here supple PVC.

The following arrangements are, furthermore, adopted:

the ends 2A, 3A of the principal limbs 2, 3 opposite the sole plate 1, the outer face 5A of the connecting bridge 5, and the outer face 6A of the secondary limb 6 most remote from the sole plate 1, are contained in the same plane P;

the width L of the secondary limbs 6, 7 is included between 0.4 and 0.6 times the distance D separating the outer faces 2B and 3B of the two principal limbs 2, 3, being, in the example shown, equal to 0.5 times this distance D;

that part of the sole plate included between the two principal limbs 2, 3 forms an upturned V 13, of which the apex 13A is contained between the said two principal limbs 2, 3;

the outer face 2B of the principal limb 2 nearest the free edge 1C of the sole plate 1 is provided with striae over the whole of its length and height;

the bearing sole plate 1 presents perforations 4 each shaped as two equal trapezia having their small bases merged into a common small base 41, these various perforations 4 being separated by solid parts;

the common small base 41 of the trapezia of a perforation has a length LP41, which is greater than half the length LG42 of a large base 42;

the width L4 of a perforation 4, equal to the sum of the heights of the two trapezia constituting it, is included between 0.5 and 1 times the length LG42 of the large base 42 of a trapezium;

the distance L43 of the solid part separating the angles 43 of two large bases 42 of the trapezia of two successive perforations 4 is included between 0.4 and 0.6 times the length LG42 of the large base 42 of a trapezium, here equal to 0.5 times LG42;

said trapezia are isosceles trapezia; the lower face 1B of the bearing sole plate 1 comprises parallel striae over the whole of its length and width;

the upper face 1A of the solid parts of the bearing sole plate 1 comprises parallel striae over the whole of its length and width.

It may be noted, with reference to FIGS. 1, 2 and 5, that the perforations 4 have a shape presenting four angles 43 constituting anchoring corners, which allow a perfect seal in the adhesive mortar 8 for laying the tiles 9 which cover the slab 10 of a concrete flooring. The profiled strip is thus solidly fixed and definitively immobilized with respect to tiles 9. The ends 6B, 7B of these secondary limbs 6, 7 are only in abutment on the face 11A of the partition 11, which is covered with a tiling 12 fixed with adhesive mortar 8. The lower edge 12A of the tiling 12 is disposed opposite and virtually contiguous with the plane P of the faces 2A, 5A, 3A and 6A, without being fixed to the profiled strip. A complete separation of the profiled strip with respect to the partition 11 and with respect to the tiling 12 covering it, is therefore noted.

Furthermore, as this profiled strip is well fixed to the mortar 8 bonding the tiles 9 to the slab 10 of the flooring, it follows the displacements of the flooring and makes a sliding joint which permanently conserves a satisfactory appearance. It should be noted that the elastic bridge 5 allows a certain horizontal suppleness of the profiled strip, whilst the principal limbs 2, 3 and secondary limbs 6, 7, which are rigid, ensure a perfect vertical maintenance of the lower part of the tiling 12.

In a variant embodiment, the profiled strip may be made as shown in FIGS. 3 and 4.

In these Figures, it may be observed that the variant profiled strip presents the features of the profiled strip of FIGS. 1 and 2, designated by the same reference numerals, except for the following points:

the V structure 13 which connects the principal limbs 2 and 3, is oriented with the apex of the V directed normally downwardly, the arms 13B of the V being connected to the median parts of the inner faces 2C and 3C of said principal limbs 2 and 3;

this V structure is monobloc and made at the same time and in the same material as the principal limbs 2 and 3, here of hard, semi-rigid PVC;

the secondary limbs 6 and 7 are made of a material different from that of the principal limbs 2 and 3, more generally made of a supple material and here, made of supple PVC, and are connected to the outer face 3B of the principal limb 3;

the connecting bridge 5 has a cross-section in the form of a trapezium, here an isosceles trapezium, of which the sides 5B connect the two parallel bases 5A and 5C, these bases in addition extending parallel to the sole plate 1, the upper base 5A being contained in the plane P, which also contains the upper ends 2A, 3A of the principal limbs 2, 3, respectively, and the outer face 6A of the secondary limb 6;

sides 5B of the connecting bridge 5 are applied on the faces of sharp projections 2D, 3D extending from the inner faces 2C, 3C of the principal limbs 2, 3.

According to the embodiment of FIG. 3, the large base of the trapezium of the connecting bridge 5 constitutes the upper base 5A of the trapezium, and the projections 2D, 3D are connected to the inner faces 2C of the principal limbs 2, 3, each by two oblique faces, respectively.

According to the embodiment of FIG. 4, the small base of the trapezium of the connecting bridge 5 constitutes the upper base 5A of the trapezium and the projections 2D, 3D are connected to the inner faces 2C of the principal limbs 2, 3, each by an oblique face and by the end 2A, 3A of the corresponding principal limb, respectively.

In each of the embodiments of FIGS. 1 and 2, of FIG. 3 and of FIG. 4, the profiled strip is obtained by simultaneously extruding the two materials—hard PVC and supple PVC—constituting it, such extrusions being made hot as far as the tests effectively carried out are concerned.

The profiled strip of FIGS. 1 and 2 thus results from the simultaneous extrusions, on the one hand, of the material constituting the sole plate 1–13, the principal limbs 2, 3 and the secondary limbs ting the connecting bridge 5.

The profiled strips of FIGS. 3 and 4 are each obtained by simultaneous extrusions, on the one hand, of the material constituting the sole plate 1, the principal limbs 2, 3 and the V structure 13, and, on the other hand, of the material constituting the secondary limbs 6, 7 and the connecting bridge 5. It should be noted that the secondary limbs 6, 7 and the connecting bridge 5 are, in these two variant embodiments, made of the same material.

The invention is not limited to the embodiments described, but covers, on the contrary, all the variants that may be made thereto without departing from their scope nor spirit.

What is claimed is:

1. A profiled corner strip for interconnecting a wall covering and a floor covering disposed at substantially a 90 degree angle, said profiled corner strip comprising:

a) an elongate sole plate including a lower surface, an upper surface, and a longitudinal edge;

b) a first support limb formed in and extending perpendicular to the upper surface of said sole plate along an edge of said sole plate opposite the longitudinal edge, said first support limb having an outer surface for bonding said first support limb to an edge of a floor covering;

c) a second support limb connected to said first support member in parallel, spaced-apart relationship;

d) spacer means extending from an outer surface of said second support limb for engaging a wall;

e) bridge means positioned between said first support limb and said second support limb such that an outer edge of said first support limb, an outer surface of said bridge means, an outer edge of said second support limb, and an outer surface of said spacer means form a planar surface to slidingly support a wall covering mounted on the wall whereby said bridge means compensates for the relative displacement of the floor covering to maintain a joint between the floor covering and the wall covering.

2. The profiled strip defined in claim 1 wherein said spacer means includes two secondary limbs in spaced-apart relationship extending from the outer surface of said second support limb.

3. The profiled strip defined in claim 2 wherein the two secondary limbs are in parallel relationship to said sole plate.

4. The profiled strip defined in claim 1 wherein said sole plate, said first support limb, said second support limb, and said spacer means are made from a hard, semi-rigid material and said bridge means is made from a supple material.

5. The profiled strip defined in claim 4 wherein said spacer means is made from a supple material.

6. The profiled strip defined in claim 4 wherein the hard material includes semi-rigid polyvinyl chloride and the supple material includes soft polyvinyl chloride.

7. The profiled strip defined in claim 1 wherein the width of said spacer means is equal to approximately one-half of the distance between the outer surface of said first support limb and the outer surface of said second support means.

8. The profiled strip defined in claim 1 including a V-shaped connector integrally formed between an inner surface of said first support limb and an inner surface of said second support limb.

9. The profiled strip defined in claim 8 wherein said V-shaped connector is extends from a median point on the inner surface of said flat support limb to a median point on the inner surface of said second support limb.

10. The profiled strip defined in claim 1 wherein said bridge means is provided with a rectangular cross-sectional configuration.

11. The profiled strip defined in claim 1 wherein said bridge means is provided with a trapezoidal cross-sectional configuration which includes the outer surface, an inner surface parallel to the outer surface, and two sides.

12. The profiled strip defined in claim 11 wherein projections are formed on the inner surface of said first support limb and on the inner surface of said second support limb whereby the two sides of the bridge means are affixed to the projections.

13. The profiled strip defined in claim 1 wherein the outer surface of said first support limb includes a striated surface.

14. The profiled strip defined in claim 1 wherein the upper surface of said sole plate and the lower surface of said sole plate include a segment adjacent to the longitudinal strip provided with parallel striae extending longitudinally along said sole plate.

15. The profiled strip defined in claim 1 wherein said sole plate includes spaced-apart apertures between the lower surface and the upper surface of said sole plate.

16. The profiled strip defined in claim 15 wherein said sole plate includes hexagonal segments of sole plate between said apertures.

17. The profiled strip defined in claim 1 wherein said bridge means is made from a pliable material whereby said bridge means slidingly engages a lower edge of the wall covering during the expansion and contraction of said bridge means caused by the displacement of the floor covering.

18. The profiled strip defined in claim 1 wherein said sole plate, said first support limb, said second support limb, and said spacer means are an extrusion of semi-rigid polyvinyl chloride material and said bridge means is an extrusion of supple polyvinyl chloride material co-extruded with and bonded by the co-extrusion process to said first support limb and said second support limb.

19. The profiled strip defined in claim 1 wherein said sole plate, said first support limb, and said second support limb, are an extrusion of semi-rigid polyvinyl chloride material and spacer means and said bridge means are an extrusion of supple polyvinyl chloride material co-extruded with and bonded by the co-extrusion process to said first support limb and said second support limb.

20. A process for manufacturing a profile strip including the steps of:

a) preparing a hard, semi-rigid material for extrusion;

b) preparing a supple material for extrusion;

c) coextruding a sole plate, a first support limb, a second support limb, and a spacer means from the hard, semi-rigid material and a bridge means from the supple material; and d) bonding the hard, semi-rigid material to the supple material whereby a profile strip is formed.

21. A process for manufacturing a profile strip including the steps of:

a) preparing a hard, semi-rigid material for extrusion;

b) preparing a supple material for extrusion;

c) coextruding a sole plate, a first support limb, and a second support limb from the hard, semi-rigid material, and a bridge means and a spacer means from the supple material; and d) bonding the hard, semi-rigid material to the supple material whereby a profile strip is formed.

* * * * *